US005412923A

United States Patent [19]

Lashyro et al.

[11] Patent Number: 5,412,923

[45] Date of Patent: May 9, 1995

[54] TRAY PACKAGING OF STACKED ARTICLES

[75] Inventors: Jeffrey A. Lashyro; Allen L. Olson, both of Crosby, Minn.

[73] Assignee: Riverwood International Corporation, Denver, Colo.

[21] Appl. No.: 138,599

[22] Filed: Oct. 18, 1993

[51] Int. Cl.[6] ..... B65B 13/02; B65B 11/58; B65B 35/50

[52] U.S. Cl. ..... 53/399; 53/397; 53/447; 53/449

[58] Field of Search ..... 53/48.2, 48.4, 48.5, 53/48.7, 397, 398, 399, 441, 442, 445, 447, 157, 446, 544

[56] References Cited

U.S. PATENT DOCUMENTS 2,731,776 1/1956 Currie ..... 53/413 X
2,961,810 11/1960 Johnson et al. ..... 53/445 X
3,201,912 8/1965 Wozniak .
3,490,353 1/1970 Madonia ..... 53/445
3,504,476 4/1970 Ehrenfried et al. ..... 53/445 X
3,850,282 11/1974 Calvert et al. .
3,861,530 1/1975 Calvert .
3,866,386 2/1975 Ganz ..... 53/413 X
4,036,362 7/1977 Ullman ..... 53/48.2 X
4,841,711 6/1989 Lems et al. ..... 53/398
4,947,624 8/1990 Cones et al. ..... 53/447 X
4,962,625 10/1990 Johnson et al. ..... 53/157
5,129,211 7/1992 Anderson ..... 53/399
5,168,989 12/1992 Benno ..... 53/398 X

*Primary Examiner*—Linda B. Johnson
*Attorney, Agent, or Firm*—Anthony G. Eggink

[57] ABSTRACT

A method to form and package stacked article groups utilizing cardboard trays. The method provides first and second streams of article groups which are initially formed in first and second cardboard tray structures and subsequently stacked and united into packaged stacked units.

16 Claims, 1 Drawing Sheet

TRAY PACKAGING OF STACKED ARTICLES

BACKGROUND OF THE INVENTION

This invention relates to the packaging of stacked articles to form stacked article units. Particularly, this invention relates to methods of forming and packaging stacked articles utilizing cardboard trays.

The packaging of stacked articles, such as beverage and food containers and the like, has been found to be an economical and well accepted means to distribute products. These benefits extend to both the distributor and to the consumer. The primary limitation to the distribution of stacked articles, such as stacked beverage cans, has been the ability to form and package such stacked article groups in a fast and economical manner. The methods of this invention utilize cardboard trays to form and provide such stacked article groups.

SUMMARY OF THE INVENTION

The present invention provides a method of forming and packaging stacked articles utilizing cardboard tray structures. The method comprises providing first and second streams of article groups and forming a base tray member about the bottom of each first and second article group during movement in each respective stream. The second stream of article groups is next directed onto the tops of the formed first stream and subsequently the resultant stacked article units are united to form a stream of packaged stacked article units.

It is an object of the present invention to provide processes of forming stacked article group units which may utilize existing cardboard tray article grouping machinery. By utilizing the process steps of the invention stacked article group units are provided in a fast and economical method.

These and other benefits will become clear from the following description by reference to the drawings.

DESCRIPTION OF THE PREFERRED EMBODIMENT

Figure 1:
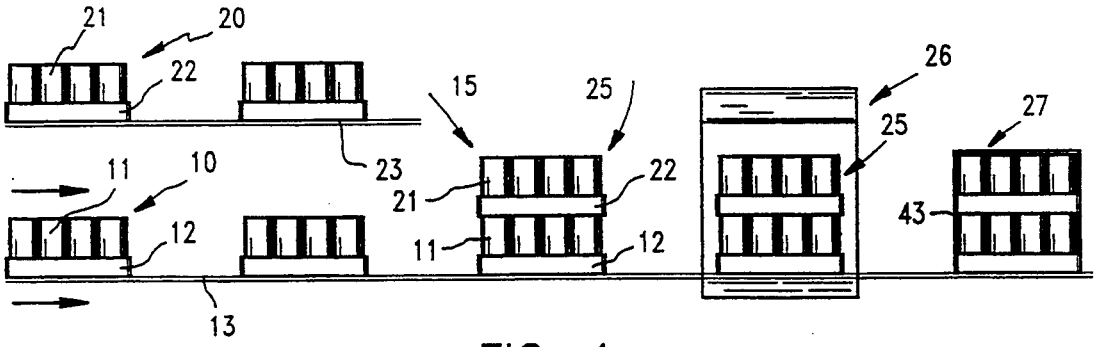
FIG. 1 is a flow diagram showing the method of this invention.

FIG. 1 is a flow diagram of a packaging method of the present invention. As shown, a first stream 10 of article groups 11 are moved by a conveyor 13. The article groups 11 are preselected and provided in a bottom tray 12. For example, the article groups 11 may be four, six or twelve beverage cans and the tray structures 12 may be cardboard base members which are formed about each article group 11 on conveyor 13 or which are placed on conveyor 13 to have a group 11 placed therein. Thus, the trays 12 may be formed about the bottoms of the preselected groups, or the preselected groups may be moved onto the tray structures.

Simultaneous with the travel of article groups 11 on conveyor 13, a second stream 20 of article groups 21 is provided on conveyor 23. The article groups 21 are also shown contained in bottom tray members 22 and which are positioned in this configuration in a manner similar to that described above with respect to the first stream 10. The second stream 20 is conveyed within reach of first stream 10 whereby a transfer step 15 moves and places the second stream 20 on top of the first stream 10. As shown, the first and second article groups 11 and 12 and the corresponding bottom trays 12 and 22 are aligned to form stacked article groups 25 which are conveyed on conveyor 13. The bottom trays 12 provide unitary article group structures which permit the bottom trays 22 to be slid or otherwise transferred onto the first stream 10. Thereafter, a packaging wrapping supply 26 is utilized to form packaged stacked article groups 27. The packaging supply 26 may comprise rolls of shrink film, stretch film or a wrapping paper which unite the stacked groups via a process known in the packaging art.

Figure 2:
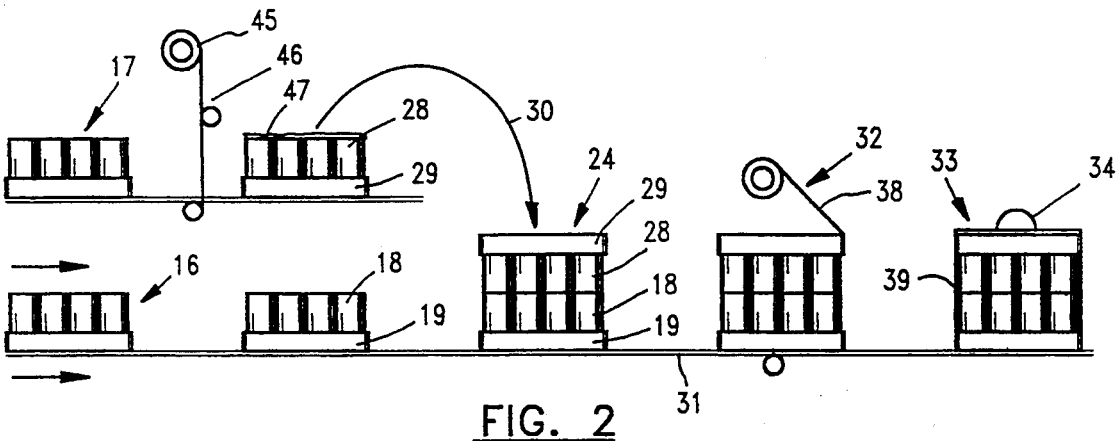
FIG. 2 is a flow diagram showing an alternate method of this invention.

Alternatively, as shown in FIG. 2, the second stream of formed groups 17 is rotated via means 30 in an upside down configuration onto the top of the first stream 16 of formed groups whereby the first and second trays 19 and 29, respectively, form the bottom and top of the stacked article groups 24. A flexible film wrap about the formed groups 17 may be preferred to aid in the stable rotational transfer step 30. For example, as shown, a packaging film source 45 is located in line with the second stream of article groups 17 whereby a film or packaging wrapping step 46 is used to provide wrapping 47 about the article groups 28 contained in tray 29.

Figure 3:
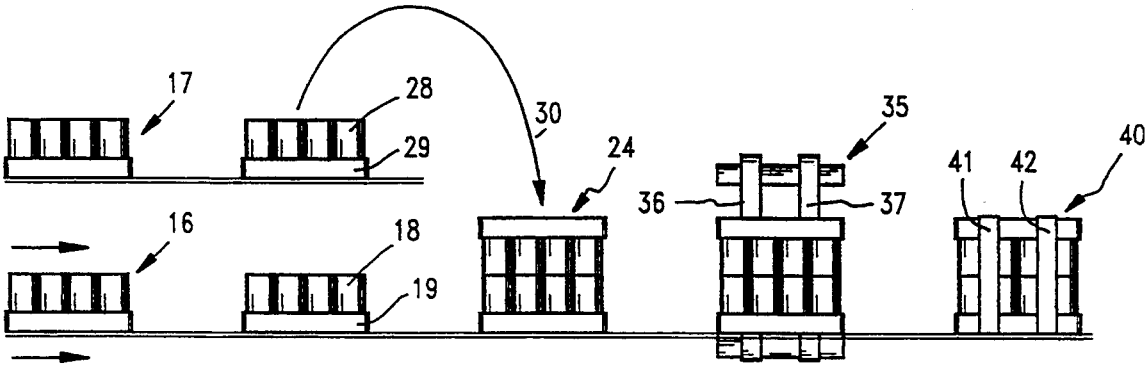
FIG. 3 is a flow diagram showing another method of this invention.
Figure 4:
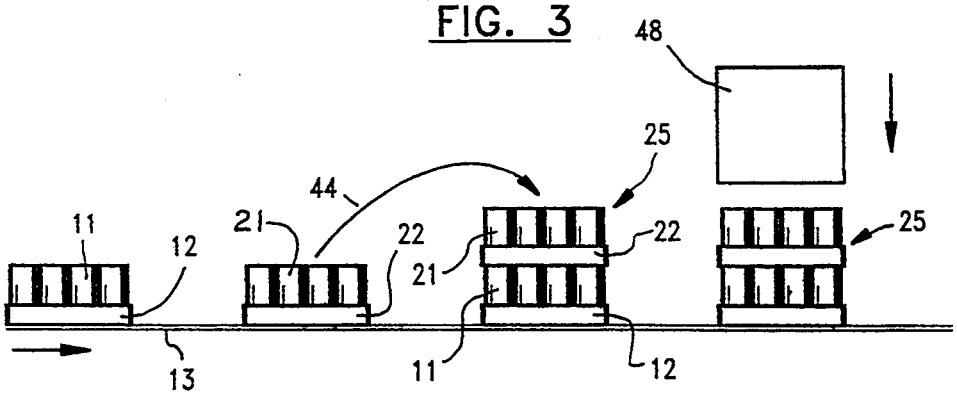
FIG. 4 is a flow diagram showing another method of the invention.

Subsequently, the stacked article units 24 are united to form a packaged stacked article carrier 33 for consumer use. The uniting step of the process comprise wrapping a sleeve structure about the stacked article unit 24. The sleeve 48 may compromise a flexible film such a shrink or stretch wrap or a cardboard or paper sleeve structure as shown in FIG. 4. As shown in FIG. 2, a packaging film source 32 is positioned adjacent the conveyor 31 whereby film 38 is continually supplied in line with the movement of the stacked article units 24 so that packaged stacked units 33 are provided having packaging wraps 39. Preferably, each stacked unit 33 further has handle members 34, which may be initially supplied on the bottoms of trays 29. Alternatively, and as shown in FIG. 3, the stacked article structure 24 may be united by a strapping means 35, whereby straps or bands 36 and 37 are wrapped about each stacked article structure 24 to provide packaged units 40 having straps 41 and 42. It is also preferred that the completed packaged unit 40 has handle means which may be provided as part of the tray configuration or by the materials utilized in the uniting step, as discussed with respect to FIG. 2.

FIG. 4 illustrates another method of the invention wherein the first and second streams of article groups 16 and 17, discussed above, are provided on a single conveyor 13. As shown, a transfer step 44 moves alternate article groups onto an adjacent article group structure contained in a cardboard tray. The transfer step 44 is preferably accomplished in a continuous manner and may utilize equipment known in the packaging or material handling art. Subsequent to the formation of the stacked article groups 25, the uniting step as discussed with respect to the methods shown in FIGS. 1–3 may be utilized to form the packaged stacked carrier units. As shown, a sleeve structure 48 may be lowered onto the stacked article group 25 to thereby form a packaged stacked unit.

As many changes are possible to the processes of this invention utilizing the teachings thereof, the descriptions above, and the accompanying drawings should be interpreted in the illustrative and not the limited sense.

That which is claimed is:

1. A continuous method to form and package stacked article units comprising:

a) providing first and second streams of preselected article groups;

b) forming a rigid base member about the bottoms of each said preselected first and second article groups;

c) wrapping a flexible film about each said preselected article group of said second stream to form a stream of unitary structures;

d) rotating each said wrapped unitary article group of said second stream 180 degrees whereby said base member is faced in an upwardly direction;

e) directing said formed second stream of rotated article groups onto the tops of said first formed stream of article groups to form stacked article units;

f) uniting each said stacked article unit by wrapping a flexible film structure about each said stacked article unit; and g) fixing said flexible film structure about each said stacked article unit.

2. The method of claim 1, wherein said uniting step comprises wrapping a sleeve about said stacked article unit.

3. The method of claim 2, wherein said wrapping step comprises fixing said sleeve to the base of each said stream of formed article groups.

4. The method of claim 1, wherein said uniting step comprises lowering a preformed open sleeve over each said stacked article unit.

5. The method of claim 1, wherein said uniting step comprises wrapping a strap about each said stacked article unit.

6. The method of claim 1, wherein said uniting step includes placing a handle member of each said stacked article unit.

7. A continuous method to form and package stacked article units comprising:

a) providing first and second streams of preselected article groups, each said first and second article groups being placed in a rigid base tray structure having a peripheral lip for containing said article groups;

b) directing said formed second stream of article groups onto the tops of said first formed stream of article groups to form stacked article units;

c) lowering a preformed open cardboard or paper sleeve structure over each said stacked article unit; and d) uniting each said stacked article unit by fixing said preformed sleeve structure to said base tray structures of each said stacked article unit.

8. The method of claim 7, further including the steps of wrapping a flexible film about each said preselected article group of said second stream and rotating each said wrapped article group of said second stream 180 degrees and onto said article groups of said first stream.

9. The method of claim 7, wherein said uniting step further includes placing a handle member on each said stacked article unit.

10. The method of claim 7, wherein said base tray structures provided are constructed of cardboard.

11. The method of claim 7, wherein said uniting step further comprises wrapping at least one strap about each said stacked article unit.

12. The method of claim 1, wherein said rigid base members provided comprise cardboard trays.

13. A continuous method to form and package stacked article units comprising:

a) providing a first stream of preselected article groups in a base tray member;

b) providing a second stream of preselected article groups in a base tray member;

c) wrapping a flexible film about each said article group of said second stream to form a stream of unitary structures;

d) rotating each said unitary article group of said second stream 180 degrees to face said base tray member in an upward direction and directing said rotated unitary groups onto the tops of said first stream of article groups to form stacked article units, each unit having base members disposed on the bottom and the top thereof; and e) uniting each said stacked article unit by lowering a preformed open sleeve structure over each stacked article unit and fixing said sleeve structure to said base tray members to thereby form unitary stacked article units.

14. The method of claim 13, wherein said base tray members provided are constructed of cardboard.

15. The method of claim 13, wherein said uniting step further comprises wrapping at least one strap about each said stacked article unit.

16. The method of claim 13, wherein a handle member is provided on each said stacked article unit.

* * * * *